US010252530B2

(12) United States Patent
Moya Rojo et al.

(10) Patent No.: US 10,252,530 B2
(45) Date of Patent: Apr. 9, 2019

(54) SPITTOON SYSTEM, PRINTER AND METHOD FOR A PRINTING MECHANISM

(71) Applicant: Hewlett-Packard Development Company, L.P., Houston, TX (US)

(72) Inventors: Oscar Moya Rojo, Sant Cugat del Valles (ES); Rafael Ulacia Portoles, Barcelona (ES); Joaquim Brugue Garvi, Barcelona (ES); Daniel Gonzalez Perello, Terrassa (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/570,142

(22) PCT Filed: Jun. 9, 2015

(86) PCT No.: PCT/EP2015/001160
§ 371 (c)(1),
(2) Date: Oct. 27, 2017

(87) PCT Pub. No.: WO2016/198083
PCT Pub. Date: Dec. 15, 2016

(65) Prior Publication Data

US 2018/0126734 A1 May 10, 2018

(51) Int. Cl.
*B41J 2/165* (2006.01)
*B41J 2/17* (2006.01)

(52) U.S. Cl.
CPC ..... *B41J 2/16508* (2013.01); *B41J 2/16511* (2013.01); *B41J 2/16517* (2013.01); *B41J 2/16523* (2013.01); *B41J 2/16526* (2013.01); *B41J 2/16547* (2013.01); *B41J 2/16585* (2013.01); *B41J 2/1721* (2013.01); *B41J 2002/1657* (2013.01);
(Continued)

(58) Field of Classification Search
CPC ..... B41J 2/16505; B41J 2/16508; B41J 2/16511; B41J 2/16517; B41J 2/16523; B41J 2/16526; B41J 2/16547; B41J 2/16585; B41J 2/1721; B41J 2002/1657; B41J 2002/16555; B41J 2002/16573; B41J 2002/1728; B41J 2002/1742
See application file for complete search history.

(56) References Cited

U.S. PATENT DOCUMENTS 4,340,897 A * 7/1982 Miller ..... B41J 2/16538 347/33
4,728,970 A * 3/1988 Terasawa ..... B41J 2/16523 347/30
(Continued)

FOREIGN PATENT DOCUMENTS

WO WO-2016198083 12/2016

*Primary Examiner* — Anh T. N. Vo
(74) *Attorney, Agent, or Firm* — Michael A. Dryja

(57) ABSTRACT

A spittoon system for a printing mechanism includes a reservoir elongated in a longitudinal direction and having a bottom part. The reservoir receives printing fluid residue spit from a print-head onto a first zone of the reservoir. The spittoon system further includes a cleaning element arranged inside the reservoir to transfer, by sliding along the longitudinal direction of the reservoir, the received printing fluid residue from the first zone to a second zone. The second zone includes a drain outlet to drain the printing fluid residue from the reservoir.

20 Claims, 7 Drawing Sheets

(52) U.S. Cl.
CPC ..... *B41J 2002/16555* (2013.01); *B41J 2002/16573* (2013.01); *B41J 2002/1728* (2013.01); *B41J 2002/1742* (2013.01)

(56) References Cited

U.S. PATENT DOCUMENTS

| | | | | |
|---|---|---|---|---|
| 5,621,441 | A * | 4/1997 | Waschhauser | B41J 2/16511 347/32 |
| 5,956,053 | A * | 9/1999 | Michael | B41J 2/16511 347/29 |
| 6,213,583 | B1 | 4/2001 | Therien | |
| 6,312,094 | B1 | 11/2001 | Ito et al. | |
| 6,557,972 | B2 | 5/2003 | Therien | |
| 6,834,931 | B2 | 12/2004 | Ang et al. | |
| 7,828,407 | B2 | 11/2010 | Gomez et al. | |
| 8,132,890 | B2 * | 3/2012 | Umeda | B41J 2/16523 347/31 |
| 8,246,142 | B2 | 8/2012 | Hibbard et al. | |
| 2002/0158941 | A1 * | 10/2002 | Vega | B41J 2/16508 347/35 |
| 2002/0180828 | A1 * | 12/2002 | Webster | B41J 2/16508 347/34 |
| 2003/0067506 | A1 | 4/2003 | Rotering | |
| 2005/0093946 | A1 | 5/2005 | Tanner et al. | |
| 2011/0279524 | A1 | 11/2011 | Love et al. | |
| 2013/0033541 | A1 | 2/2013 | Singh | |

* cited by examiner

SPITTOON SYSTEM, PRINTER AND METHOD FOR A PRINTING MECHANISM

BACKGROUND

The description refers to a spittoon system for a printing mechanism and a printer. It further refers a method for purging printing fluid residue received in a spitting process from a printing mechanism.

BRIEF DESCRIPTION OF THE DRAWINGS

Examples will be described, by way of example only, with reference to the accompanying drawings in which corresponding reference numerals indicate corresponding parts and in which.

DETAILED DESCRIPTION

In a service routine of a printing mechanism, the nozzles of its print-head are refreshed by firing a number of drops of printing fluid through each of the nozzles in a process known as "spitting" with the residue printing fluid being collected in a "spittoon" reservoir portion of the service station.

When spitting printing fluid onto the bottom of a reservoir, over a period of time the rapidly solidifying printing fluid residue grows into a stalagmite of printing fluid residue. This stalagmite might contact the print-head and thereby interfere print quality or contributes to clog the nozzles.

Figure 1:
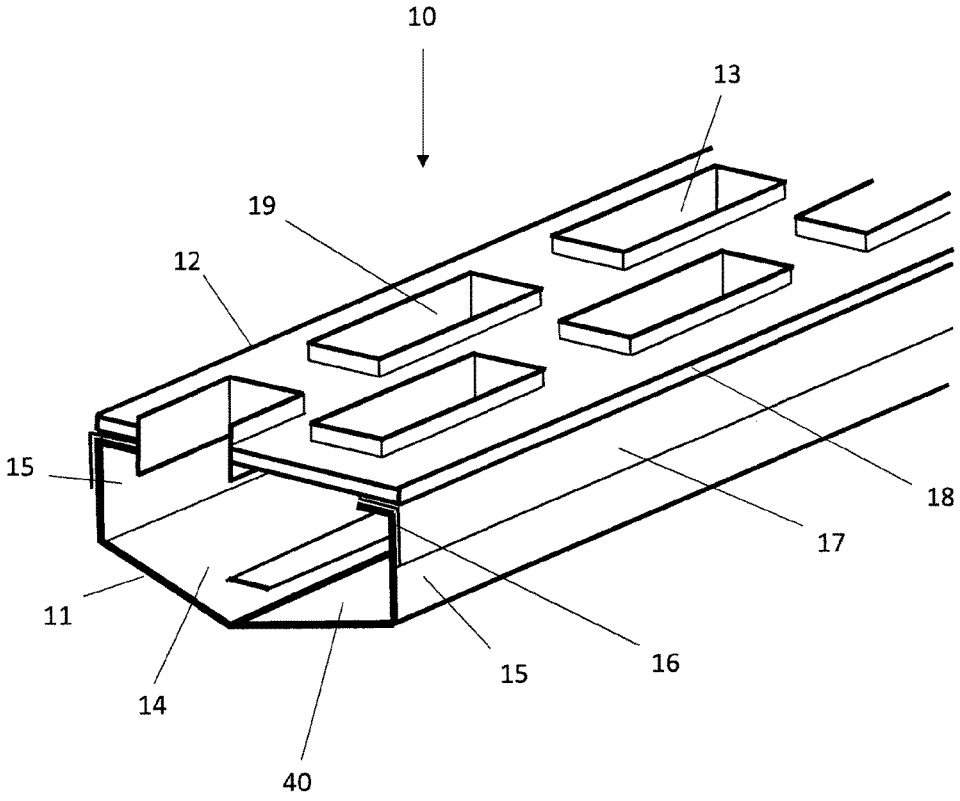
FIG. 1 is an illustration of an example printer which has a spittoon system with a reservoir according to an example.

FIG. 1 is a schematic illustration of an example printer. The printer includes a spittoon system having a reservoir 10 elongated in a longitudinal direction. The reservoir 10 comprises a bottom part 11 and a cover part 12. The section of the bottom part 11 shown in FIG. 1 represents a first zone 40 connected in longitudinal direction of the reservoir to a second zone 30 (shown in FIG. 3). Thus, in some examples the first and second zones 30 are separated in the longitudinal direction of the reservoir 10. The first zone 40 of the bottom part 11 receives the printing fluid, e.g. ink, spit from the print-head during a spitting process onto the first zone 40. In some examples, the bottom part 11 of the reservoir 10 is made of a sheet metal. The bottom part 11 has a floor portion 14 and first and second sidewall portions 15, each portion extending in the longitudinal direction. In some examples, the floor portion 14 of the bottom part 11 is V-shaped in the longitudinal direction to accumulate the printing fluid received in the reservoir during the spitting process. Thus, caused by the V-shaped bottom part 11, the own liquid height of printing fluid in the V-shaped bottom part 11 makes the printing fluid moving by gravity to a drain collector 34 in the second zone 30 (shown in FIGS. 3 and 4). This reduces the number of cleaning cycles needed. In other examples, the floor portion 14 of the bottom part 11 is U-shaped or semi-circularly shaped. The first and second sidewall portions 15 are aligned parallel to each other, in some examples.

The cover part 12 of the reservoir 10 has a spit-through opening 13 through which printing fluid is spit from the print-head onto the first zone 40 of the bottom part 11 during a print-head spitting process. In some examples, the cover part 12 includes a plurality of spit-through openings 13 each one corresponding to one of a plurality of print-heads of a page-wide array (PWA) printing mechanism. In some examples, the cover part 12 includes only one spit-through opening 13 corresponding to the single print-head of a wide nozzle array printing mechanism. In some examples, the cover part 12 includes a plurality of spit-through openings 13 each one corresponding to one nozzle group of a plurality of nozzle groups of a PWA printing mechanism.

In some examples, the cover-part 12 comprises two spit-through opening zones extending along the longitudinal direction where spit-through openings 13 are located. The two spit-through opening zones are separated in a direction transverse to the longitudinal direction by a spacer zone lying between the two spit-through opening zones. In the spacer zone, no spit-through openings 13 are located. The spacer zone runs along the longitudinal direction above a belt 22 (shown in FIG. 2) which is located inside the reservoir 10. The two spit-through opening zones run along the longitudinal direction above the first zone 40 of the floor portion 14 of the bottom part 11. In some examples, the spit-through openings 13 are offset in longitudinal direction corresponding to a certain configuration of the PWA print-heads.

The cover part 12 includes a U-shaped clamping element 17 and a flat sealing element 18. The legs of the U-shaped clamping element 17 embrace the outer surfaces of the sidewall portions 15 of the bottom part 11. In some examples, the U-shaped clamping element 17 is adhered to the bottom part 11 by a double self-adhesive foam. In other examples, the U-shaped clamping element 17 is screwed with the sidewall portions 15 of the bottom part 11. The U-shaped clamping element 17 is made of a resilient material, in particular of sheet metal. In some examples, the U-shaped clamping element 17 is made of plastic material.

The flat sealing element 18 is attached to the outer surface of the base of the U-shaped clamping element 17. In some examples, clips being made of plastic are used to attach both elements 17, 18. The flat sealing element 18 is made of rubber material. During the spitting process, the flat sealing element 18 tightly abuts the print-heads, i.e. the rubber material of the flat sealing element 18 is formed such that the spit-through openings 13 are complementary to the print-heads. In some examples, the flat sealing element 18 is formed such that it abuts the print-heads in an airtight manner during the spitting process. The spit-through openings 13 are formed through the base of the U-shaped clamping element 17 and the flat sealing element 18. In some examples, the flat sealing element 18 comprises sealing lips 19 that protrudes at the circumferences of the spit-through openings 13 from the outer surface of the flat sealing element 18 and abuts the print-heads during the spitting process. The provision of such sealing lips 19 allows the closing of gaps between the flat sealing element 18 and the print-heads during the spitting process. Thus, aerosol particles existing in the reservoir 10 cannot escape through the spit-through openings 13.

Figure 2:
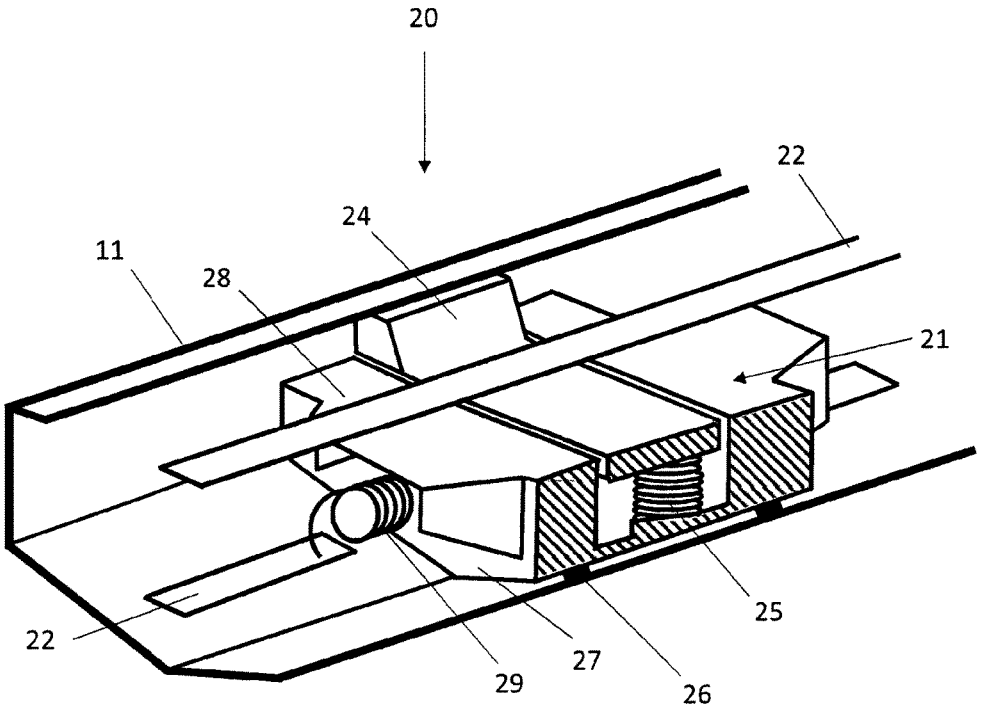
FIG. 2 is an inside view of the spittoon system comprising a cleaning carriage arranged inside the reservoir and a belt coupled to the cleaning carriage according to an example.

Now referring to FIG. 2, which illustrates an inside view of an example spittoon system 20 with the bottom part 11 of the reservoir 10, a cleaning carriage 21 arranged inside the reservoir 10 to slide along the longitudinal direction, and a belt 22. The belt 22 is part of a belt drive mechanism 52 (see also FIG. 5) which controls the movement of the cleaning carriage 21 along the longitudinal direction of the bottom part 11 of the reservoir 10.

The two face sides of the cleaning carriage 21 extending transverse to the longitudinal direction form its scraping sides 27. The cleaning carriage 21 has a scraper roof 28, a spring 25, a seal 26, and a pusher 24. The width of the cleaning carriage 21, in particular of its scraping sides 27 corresponds to the width of the bottom part 11. The cleaning carriage, in particular the bottom edge of its scraping sides 27 is formed to fit with the inner surface of the bottom part 11. Similarly, the seal 26 is coupled to the cleaning carriage 21 to fit with the inner surface of the bottom part 11. The spring 25 is loaded between the pusher 24 and the seal 26. The seal 26 engages the bottom part 11, and the pusher 24 engages a portion of the reservoir 10 to produce, loaded by the spring 25, a contact pressure between the seal 26 and the bottom part 11 of the reservoir 10.

In some examples, the sidewall portions 15 of the bottom part 11 have pusher-engaging portions 16 with respective inner surfaces facing the inner surface of the floor portion 14. In these examples, the pusher 24 engages the inner surfaces of the pusher-engaging portions 16, and the seal 26 engages the floor portion 14 of the bottom part 11. Thus, the pre-loading force exerted by the spring 25 and acting between the seal 26 and the pusher 24 ensures that no printing fluid residue passes through the gap between the cleaning carriage 21 and the bottom part 11.

In some examples, two seals 26, two scraper roofs 28, two springs 25 and one pusher 24 are part of the cleaning carriage 21 assembly. In some examples, each of the two scraping sides 27 extends over the width of the floor portion 14. Further, each of the two seals 26 is arranged next to its respective scraping side 27, i.e. the two seals 26 are spaced apart by almost the length of the cleaning carriage 21. In some examples, the two springs 25 are installed in the middle region of the cleaning carriage 21, arranged on opposite transverse sides of the cleaning carriage 21. Each of the two scraper roofs 28 is attached at the respective scraping side 27 to the cleaning carriage 21 and covers at least in part the cleaning carriage 21. In some examples, the scraper roof 28 covers at least in part the scraping sides 27 and the upper side of the cleaning carriage 21. In some examples, the upper surface of the scraper roof 28 is generally flat to prevent abrasion of the upper strand of the belt 22 running above the upper side of the cleaning carriage. The two ends of the lower strand of the belt 22 that are fixed to the opposite scraping sides 27 of the cleaning carriage 21, are lead through respective protrusions of the two scraper roofs 28 which cover the connection of the belt ends to the cleaning carriage 21. Similar to the two springs 25, the pusher 24 is installed in the middle region of the cleaning carriage 21. The pusher 24 forms part of the upper side of the cleaning carriage 21, where the pusher 24 is upwardly connected to the springs 25. When the cleaning carriage 21 is installed in the reservoir 10, the pusher 24 is clamped in between the pusher-engaging portions 15 and the floor portion 14 of the bottom part 11 of the reservoir 10. It thereby compresses the two springs 25, leading to a vertical pre-loading force which produces contact pressure between the two seals 26 and the bottom part 11 of the reservoir.

The cleaning carriage 21 is connected to the belt 22 of the belt drive mechanism 52. In some examples, the belt 22 is connected to one scraping side 27 of the cleaning carriage 21 by a pin mounted to this scraping side 27 and to the other scraping side 27 via a belt clamp end of the belt 22 connected to a spring 29, such as a traction spring, mounted to this scraping side 27.

In the above example, the belt 22 of the spittoon system 20 is an open belt, i.e. the (traction) spring 29 is used as tensioner of the belt. The belt 22 runs inside the reservoir 10 in longitudinal direction of the bottom part 11, and is driven by the drive mechanism 52. The latter one has a driven pulley 54 to apply a traction force to the cleaning carriage 21, which is transmitted depending on the cleaning carriage running direction either via the pin or via the traction spring 29 to the cleaning carriage 21. In some examples, the belt 22 is a toothed belt for the driven pulley 54 being able to provide sufficient traction force. The belt drive mechanism 52 selectively drives the belt 22 in both directions, and thereby moves the cleaning carriage 21 in both directions along the bottom part 11 of the reservoir 10 to clean the floor portion 14 and the sidewall portions 15 from printing fluid residue. In some examples, the belt 22 is arranged inside the reservoir 10 to run along a section that is not exposed to residue printing fluid spit into the reservoir 10 during the spitting process. In some examples, the belt 22 is located inside the reservoir 10 below the spacer zone of the cover part 12 running along the longitudinal direction. In other examples (not shown), in which no spacer zone exists (e.g. due to the arrangement of the print-heads in the PWA printing mechanism), two parallel belts are provided each one running close to the respective sidewall 15 of the bottom part underneath a respective zone of the cover part 12 with no spit-through openings.

Figure 3:
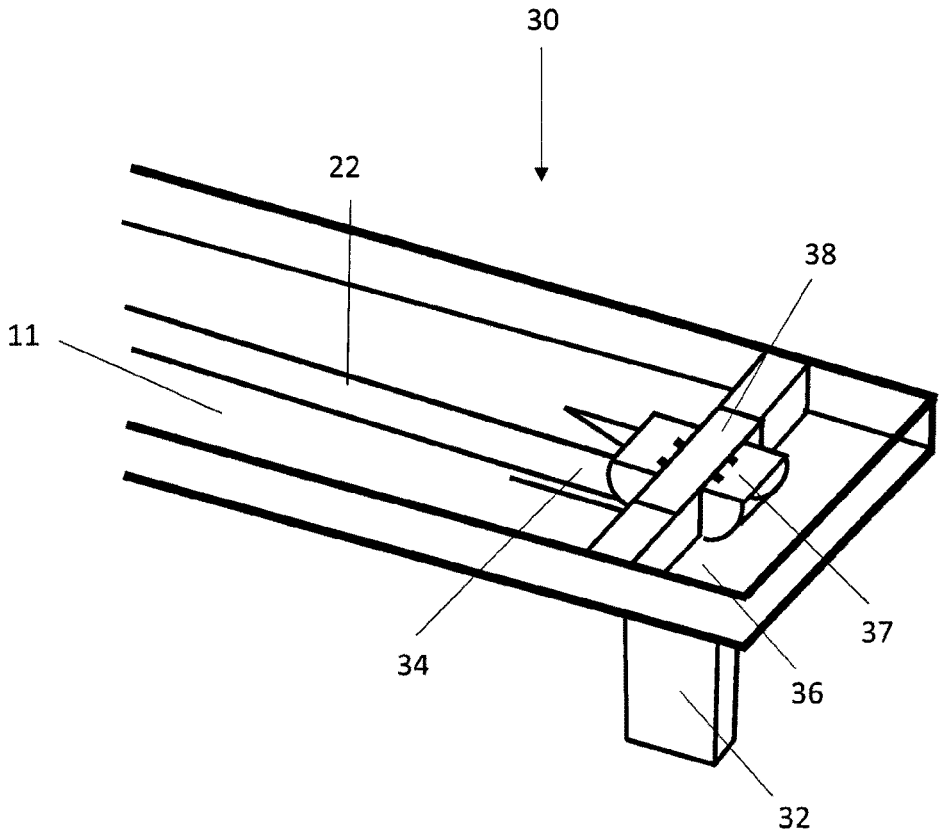
FIG. 3 is a longitudinal section view of a second zone of the bottom part having a drain outlet according to an example.

Now referring to FIG. 3, which is a longitudinal section view of a second zone 30 of the bottom part 11 having a drain outlet 32. In some examples, a drain outlet 32, a drain tube 36, a belt pulley 37 and an idle shaft 38 are provided in the second zone 30. The second zone 30 is located at a second longitudinal end of the reservoir 10. In some examples, the second zone 30 which connects to the first zone 40 of the bottom part 11, prolongs the reservoir 10 in the longitudinal direction at least so far as to provide sufficient space for the cleaning carriage 21 to keep away from the printing fluid receiving first zone 40 during the spitting process. In some examples, the bottom part 11 of the second zone 30 is made of a plastic material and is connected to the sheet metal bottom part 11 of the reservoir 10. In some examples, the bottom part of the second zone 30 encompasses the bottom part 11 of the reservoir 10 at least at their joint portion.

The second zone 30 has a drain outlet 32 to drain the printing fluid residue from the reservoir 10. Further, in some examples, the drain outlet 32 is connected via a drain tube 36 to a drain collector 34.

Figure 4:
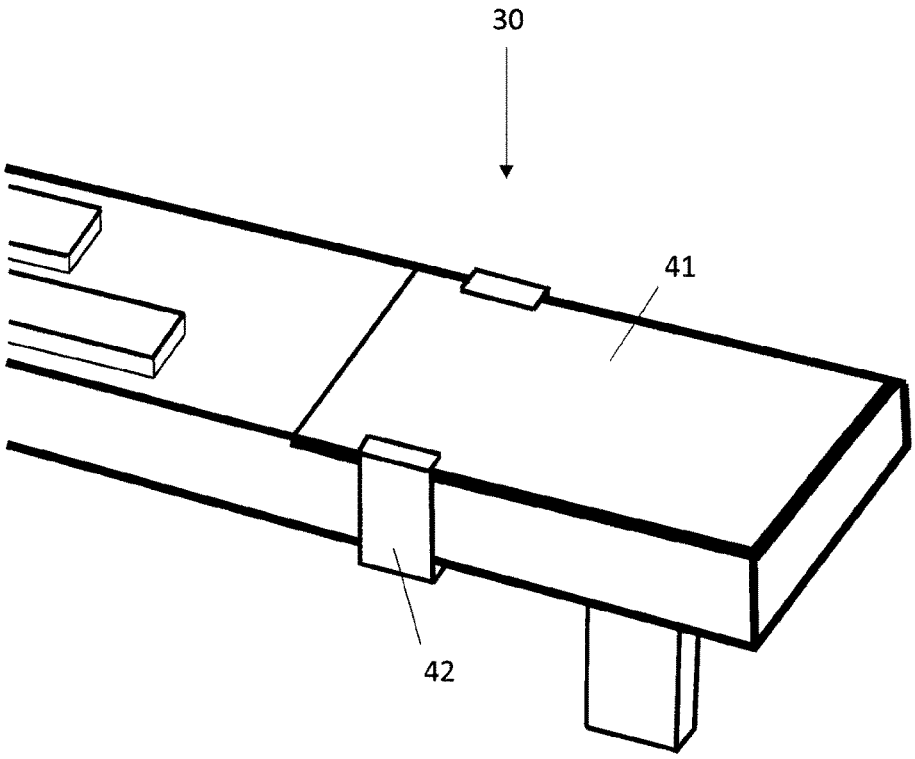
FIG. 4 is a plan view of a second zone of the bottom part having a drain outlet according to an example.

Now referring to FIG. 4, which is a plan view of the second zone 30 of the bottom part 11 having the drain outlet 32. A cover 41 closes the second zone 30. In some examples, the cover 41 is fixed to the bottom part 11 by a sealing clamp 42. In some examples, the sealing clamp 42 is made of spring metal.

Figure 5:
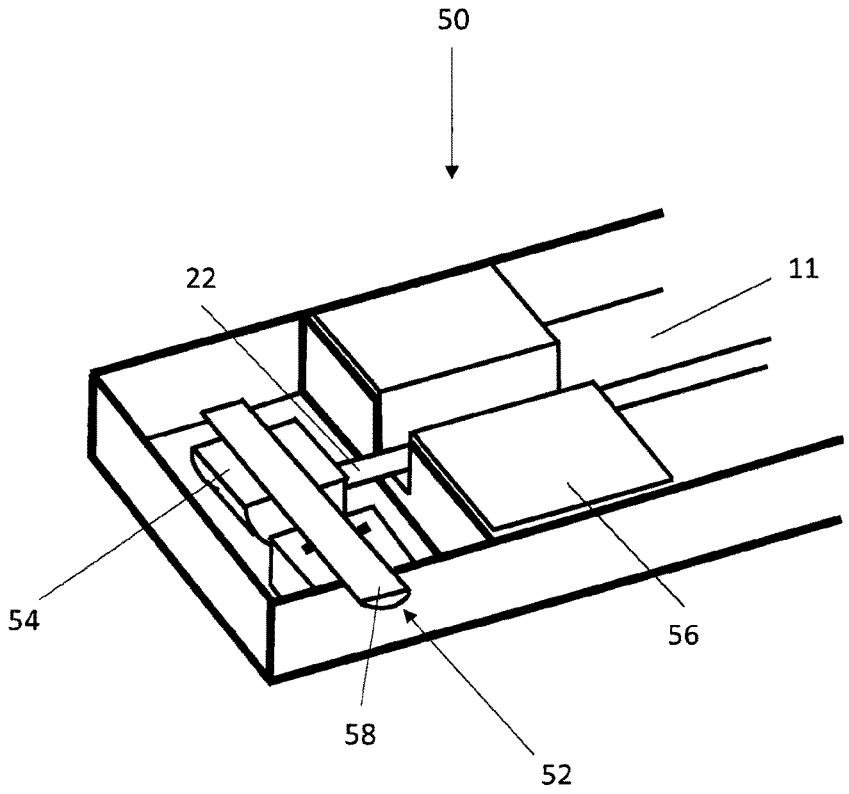
FIG. 5 is a longitudinal section view of a third zone of the bottom part located at a first longitudinal end of the reservoir having a belt drive mechanism according to an example.

Now referring to FIG. 5, which is a longitudinal section view of a third zone 50 of the bottom part 11 located at a first longitudinal end of the reservoir 10 having the belt drive mechanism 52. In some examples, the first longitudinal end of the third zone 50 is opposite to the second longitudinal end of the second zone 30. In some examples, the third zone 50 which connects to the first zone 40 of the bottom part 11, prolongs the reservoir 10 in the longitudinal direction at least so far as to provide sufficient space for the cleaning carriage 21 to keep away from the printing fluid receiving first zone 40 during the spitting process. In some examples, the bottom part 11 of the third zone 50 is made of a plastic material and is connected to the sheet metal bottom part 11 of the reservoir 10. In some examples, the bottom part 11 of the third zone 50 encompasses the bottom part 11 of the reservoir 10 at least at the joint portion between the third zone 50 and the bottom part 11. In some examples, the joint portion is sealed by a piece of foam and two O-rings to avoid leaks over the first zone 40 of the bottom part 11.

The driven pulley 54 of the belt drive mechanism 52 is located in the third zone 50 of the bottom part 11 to drive the belt 22. The driven pulley 54 is rotated by a splined shaft having its driven gear 58 located outside of the reservoir 10. A drive (not shown) meshes the driven gear 58 for selectively driving the belt 22 in the two directions. Further, a baffle 56 is located between the driven pulley 54 and the first zone 40 to prevent the printing fluid residue received in the first zone 40 during the spitting process from leaking to the driven pulley 54. The baffle 56 of the third zone 50 is made of a rubber material and its shape is adapted to the inner surface of the bottom part 11, i.e. the baffle 56 is formed to precisely fit into the bottom part 11 of the reservoir 10. In some examples, the baffle 56 is a massive rubber part. In some examples, the baffle 56 has a passage to allow the belt 22 running through it.

Figure 6:
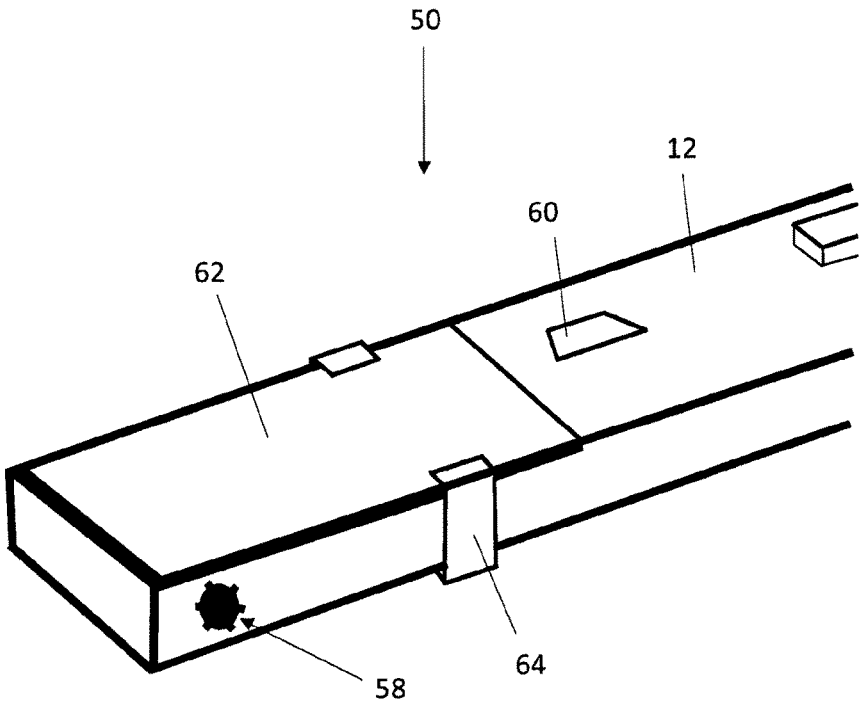
FIG. 6 is a plan view of a third zone of the bottom part located at a first longitudinal end of the reservoir having a belt drive mechanism according to an example.

Now referring to FIG. 6, which is a plan view of the third zone 50 of the bottom part 11 located at the first longitudinal end of the reservoir 10 and accommodating the belt drive mechanism 52. A cover 62 covers the third zone 50 and, in some examples, is fixed to the bottom part 11 such as to apply a vertical force to the baffle 56. The vertical force press-fits the baffle 56 (made of a rubber material) to the inner perimeter of the reservoir 10, i.e. to the floor portion 14, the sidewall portions 15 and the base of the U-shaped clamping element 17 of the cover part 12. In some examples, rips (not shown) are protruding from the inner surface of the cover 62 following the contour of the bottom part 11, which (when the cover 62 closes the bottom part of the third zone 50) prevent printing fluid residue splashed by the moving belt 22 or driven pulley 54 to leak from the reservoir into the area of the third zone 50. In some examples, a sealing clamp 64 is installed to avoid a loss of compression of the cover 62 to the bottom part 11 in the area of the third zone 50. In some examples, the sealing clamp 64 is made of a spring metal.

In some examples, the cover part 12 has an airflow window 60 which allows air flowing into the reservoir 10 during spitting or purge process. In some examples, the airflow window 60 is arranged adjacent to the spit-through openings 13. In some examples, the airflow window 60 is located in longitudinal direction opposite to the drain outlet 32. In some examples, two airflow windows 60 are formed in the cover part 12. The spittoon system 20 further includes a suction fan (not shown), wherein the suction fan is connected to the drain outlet 32 to create an airflow in the longitudinal direction from the airflow window 60 through the reservoir 10 to the drain collector 34. Thus, the suction ensures the aerosol present in the reservoir 10 immediately after the spitting process to be transported to a fan filter. This airflow inside the reservoir 10 and the rubber parts of the flat sealing element 18 ensuring an airtight abutment to the print-heads renders the printer compliant against parallelism errors.

Figure 7:
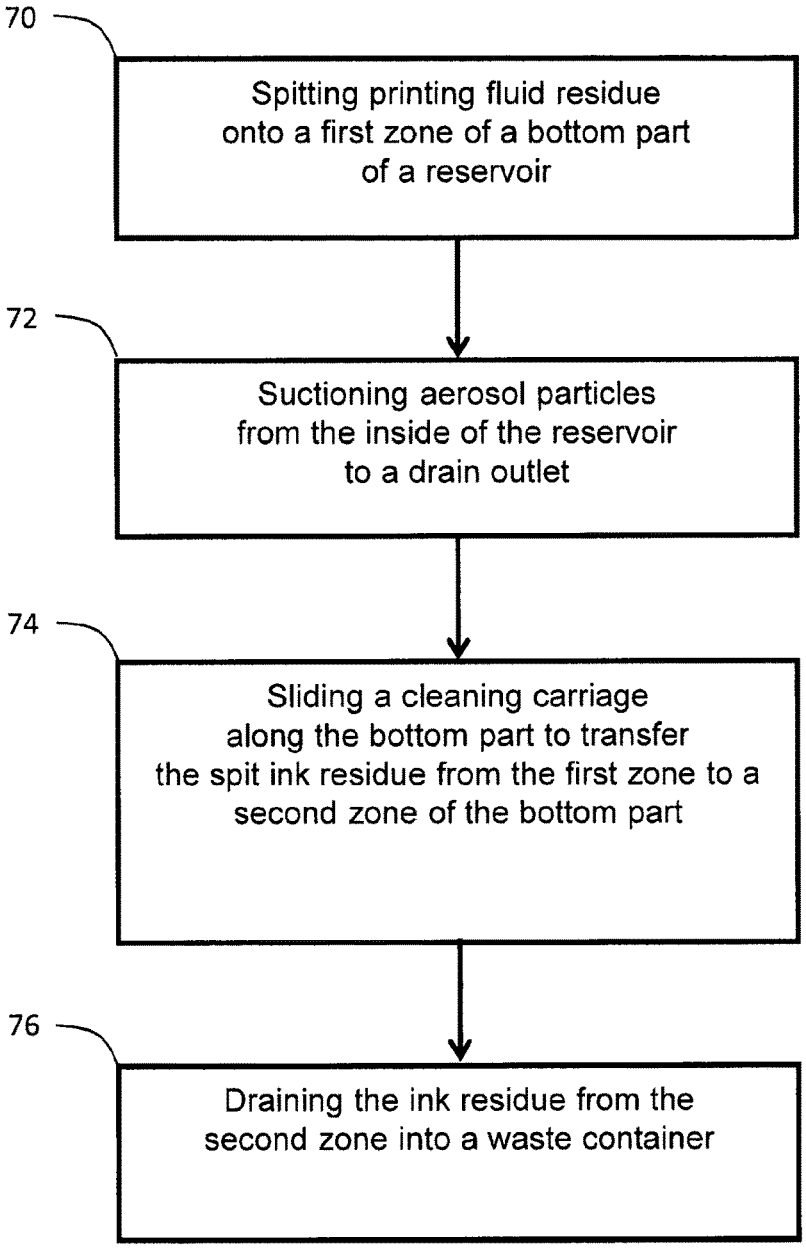
FIG. 7 is a block diagram of an example method for purging printing fluid residue from a print-head according to an example.

Now referring to FIG. 7, which illustrates an example method of purging printing fluid residue, such as ink residue, of a print-head spitting process. In one example, the spittoon system 20 is moveable from a retracted position to an engaged position, engaging the print-heads of a PWA printing mechanism. During the retracted position, the spittoon is located distal to the print-heads. The example method includes spitting, in block 70, printing fluid residue by the print-heads through the spit-through openings 13 of the cover part 12 of the reservoir 10 onto the first zone 40 of the bottom part 11 of the reservoir 10. In some examples, the printing fluid residue is simultaneously (in one shot) spit from all nozzles (e.g. more than 200.000 nozzles) of the several print-heads (e.g. 8 print-heads) of a PWA printer into the reservoir 10 by firing the nozzles at high frequencies (e.g. spitting an amount of about 130 cc per print-head into the spittoon system 20). In some examples, the print-heads abut the spit-through openings 13 in an airtight manner to prevent aerosols leaking from the reservoir 10 during the spitting process. In some examples, the spit printing fluid accumulates on the floor portion 14 of the bottom part 11, such as in the groove of the V-shaped floor portion 14. In some examples, the V-shaped bend of the floor portion 14 makes the printing fluid residue to move to the second zone 30, thus reducing the number of cleaning cycles.

In block 72, aerosol particles existing inside the reservoir 10 are exhausted by a suction fan connected to the drain outlet 32. In some examples, an airflow window 60 is located in the cover part 12 at the third zone 50 to allow air flowing into the reservoir 10. The suction fan (not shown) is mounted at the drain outlet 32 and produces when activated an airflow from the airflow window 60 through the first zone 40 to the second zone 30 of the reservoir 10. In some examples, the suction fan is connected to the drain collector 34 through the drain tube 36. The suction fan includes a waste fan filter to filter the aerosol particles from the air. The airflow inside the reservoir makes the spittoon system compliant against parallelism errors.

In block 74, the cleaning carriage 21 arranged inside the reservoir 10 and coupled to the drive mechanism 52 slides along the bottom part 11 to clean its V-shaped floor portion 14 and its two vertical sidewall portions 15. In some examples, the cleaning carriage 21 slides from the first longitudinal end of the reservoir 10 to the second longitudinal end of the reservoir 10 and back. In some examples, the cleaning carriage 21 moves from the third zone 50 through the first zone 40 to the second zone 30 each time the print-heads have spitted onto the first zone 40 of the bottom part 11. As the cleaning carriage 21 has not to be in continuous movement, the lifetime of the spittoon system is increased.

By sliding the cleaning carriage 21 along the bottom part 10, the spit printing fluid residue is transferred, as in block 74, from the first zone 40 of the bottom part 11 to a second zone 30 of the bottom part 11 of the reservoir 10. In some examples, the cleaning carriage 21 is formed to clean the floor portion 14 and the sidewall portions 15 of the reservoir 10 from printing fluid residue received during the spitting of the print-head. The second zone 30 serves as a drain collector 34 which is to collect the printing fluid residue transferred from the first zone 40 by the cleaning carriage 21. This allows collecting the printing fluid residue spit by all print-heads in one shot and later moving it to a waste container coupled to the drain collector 34. In some examples, the cleaning cycle can be done simultaneously a job is being printed.

In block 76, the printing fluid residue from the second zone 30 of the reservoir 10 is drained through the drain outlet 32 into a waste container. The floor portion 14 of the second zone 30 is formed to assist the collected printing fluid residue to flow out of the reservoir 10 through the drain outlet 32. In some examples, this floor portion 14 is formed as a ramp running into the vertical drain tube 36. Thus, the collected printing fluid residue flows down the ramp by gravity and out of the reservoir 10 through the drain tube 36. In some examples, a waste container is fixed to the drain outlet 32 to receive the printing fluid residue flown down by gravity. In some examples, the waste container is consumable that can be replaced periodically.

While several examples have been described in detail, it is to be understood that the disclosed examples may be modified. Therefore, the foregoing description is to be considered non-limiting.

What is claimed is:

1. A spittoon system for a printing mechanism, comprising:

a belt drive mechanism having a belt and a drive;

a reservoir elongated in a longitudinal direction and having a bottom part and a cover part, the bottom part having first and second zones; and a cleaning element operatively coupled via the belt to the drive, and arranged inside the reservoir to slide along the longitudinal direction;

the cover part having a spit-through opening through which printing fluid is spit from the printing mechanism onto the first zone of the bottom part during a spitting process of the printing mechanism, the cleaning element, by sliding along the longitudinal direction, to transfer the printing fluid residue from the first zone to the second zone of the bottom part, wherein the second zone has a drain outlet to drain the printing fluid residue from the reservoir, and wherein the belt drive mechanism is to drive the cleaning element along the longitudinal direction of the reservoir by applying traction force to the cleaning element.

2. The spittoon system according to claim 1, wherein the cover part includes a plurality of spit-through openings, each one corresponding to one of a plurality of print-heads of a page-wide array inkjet printing mechanism.

3. The spittoon system according to claim 1, the cleaning element further comprising a pusher, a seal and a spring loaded between the pusher and the seal, the seal engaging the bottom part, the pusher-engaging a portion of the reservoir to produce, loaded by the spring, a contact pressure between the seal and the bottom part.

4. The spittoon system according to claim 3, the bottom part comprising a floor portion and first and second sidewall portions, the floor portion comprising the first and second zones, the sidewall portions of the bottom part comprising pusher-engaging portions having respective inner surfaces facing the inner surface of the floor portion, the pusher-engaging the inner surfaces of the pusher-engaging portions, and the seal engaging the floor portion of the bottom part.

5. The spittoon system according to claim 1, wherein the cover part includes a plurality of spit-through openings each one corresponding to one of a plurality of print-heads of a page-wide array printing mechanism or each one corresponding to one nozzle group of a plurality of nozzle groups of a single print-head of a page-wide array printing mechanism, and the cover-part comprises two spit-through opening zones where spit-through openings are located and which are separated in a direction transverse to the longitudinal direction by a spacer zone lying between the two spit-through opening zones wherein in the spacer zone no spit-through openings are located, wherein the spacer zone is arranged above the belt located inside the reservoir, and the two spit-through opening zones are arranged above the first zone of the bottom part.

6. The spittoon system according to claim 1, the bottom part comprising a floor portion and first and second sidewall portions, the floor portion comprising the first and second zones, the cover part comprising a U-shaped clamping element and a flat sealing element, the flat sealing element being attached to the outer surface of the base of the U-shaped clamping element, the legs of the U-shaped clamping element embracing the outer surfaces of the sidewall portions of the bottom part, the flat sealing element tightly abutting the printing mechanism during the spitting process, and the spit-through opening penetrating the base of the U-shaped clamping element and the flat sealing element.

7. The spittoon system according to claim 6, wherein the flat sealing element comprises a sealing lip protruding at the circumference of the spit-through opening from the outer surface of the flat sealing element and abutting the printing mechanism during the spitting process.

8. The spittoon system according to claim 1, further comprising a drain tube and a drain collector, the drain outlet being connected via the drain tube to the drain collector.

9. The spittoon system according to claim 8, the reservoir further comprising an airflow window which is located in the longitudinal direction opposite to the drain outlet, and the spittoon system further comprising a suction fan, the suction fan being connected to the drain outlet to create an airflow in the longitudinal direction from the airflow window through the reservoir to the drain collector.

10. The spittoon system according to claim 1, the bottom part comprising a third zone located at a first longitudinal end of the reservoir, the second zone being located at a second longitudinal end of the reservoir, the first and second end being opposite to each other, the belt drive mechanism comprising a driven pulley for driving the belt, wherein the driven pulley is located in the third zone of the bottom part, wherein a baffle is located in the third zone between the driven pulley and the first zone to prevent the printing fluid residue received in the first zone during the spitting process from leaking to the driven pulley.

11. The spittoon system according to claim 1, the bottom part comprising a floor portion and first and second sidewall portions, the floor portion comprising the first and second zones, and the floor portion of the bottom part being V-shaped in the longitudinal direction to accumulate the printing fluid received in the reservoir during the spitting process.

12. A method for purging printing fluid residue received in a spitting process from a printing mechanism, comprising:

spitting printing fluid residue by the printing mechanism through a spit-through opening of a cover part of a longitudinally elongated reservoir onto a first zone of a bottom part of the reservoir;

sliding a cleaning element arranged inside the reservoir and coupled to a drive mechanism along the bottom part, thereby transferring the spit printing fluid residue from the first zone of the bottom part to a second zone of the bottom part of the reservoir;

suctioning by a suction fan aerosol particles from the inside of the reservoir to a drain outlet by creating an airflow in a longitudinal direction from an airflow window which located opposite the airflow window through the reservoir to a drain collector; and draining the printing fluid residue from the second zone of the reservoir through a drain outlet into a waste container.

13. A printer comprising:

a printing mechanism; and a spittoon system comprising:

a reservoir elongated in a longitudinal direction and having a bottom part and a cover part, the bottom part having first and second zones; and a cleaning element arranged inside the reservoir to slide along the longitudinal direction, the cleaning element including a pusher, a seal and a spring loaded between the pusher and the seal, the seal engaging the bottom part, the pusher engaging a portion of the reservoir to produce, loaded by the spring, a contact pressure between the seal and the bottom part;

the cover part having a spit-through opening through which printing fluid is spit from the printing mechanism onto the first zone of the bottom part during a spitting process of the printing mechanism, the cleaning element, by sliding along the longitudinal direction, to transfer the printing fluid residue from the first zone to the second zone of the bottom part, wherein the second zone has a drain outlet to drain the printing fluid residue from the reservoir.

14. The printer according to claim 13, wherein the cover part includes a plurality of spit-through openings, each one corresponding to one of a plurality of print-heads of a page-wide array inkjet printing mechanism.

15. The printer according to claim 13, wherein the spittoon system further comprises:

a belt drive mechanism having a belt and a drive, wherein the cleaning element is operatively coupled via the belt to the drive, and the drive mechanism is to drive the cleaning element along the longitudinal direction of the reservoir by applying traction force to the cleaning element.

16. The printer according to claim 13, the bottom part comprising a floor portion and first and second sidewall portions, the floor portion comprising the first and second zones, the sidewall portions of the bottom part comprising pusher-engaging portions having respective inner surfaces facing the inner surface of the floor portion, the pusher-engaging the inner surfaces of the pusher-engaging portions, and the seal engaging the floor portion of the bottom part.

17. The printer according to claim 13, the bottom part comprising a floor portion and first and second sidewall portions, the floor portion comprising the first and second zones, the cover part comprising a U-shaped clamping element and a flat sealing element, the flat sealing element being attached to the outer surface of the base of the U-shaped clamping element, the legs of the U-shaped clamping element embracing the outer surfaces of the sidewall portions of the bottom part, the flat sealing element tightly abutting the printing mechanism during the spitting process, and the spit-through opening penetrating the base of the U-shaped clamping element and the flat sealing element.

18. The printer according to claim 13, wherein the spittoon system further comprises:

a drain tube and a drain collector, the drain outlet being connected via the drain tube to the drain collector.

19. The printer according to claim 13, the bottom part comprising a third zone located at a first longitudinal end of the reservoir, the second zone being located at a second longitudinal end of the reservoir, the first and second end being opposite to each other, the belt drive mechanism comprising a driven pulley for driving the belt, wherein the driven pulley is located in the third zone of the bottom part, wherein a baffle is located in the third zone between the driven pulley and the first zone to prevent the printing fluid residue received in the first zone during the spitting process from leaking to the driven pulley.

20. The printer according to claim 13, the bottom part comprising a floor portion and first and second sidewall portions, the floor portion comprising the first and second zones, and the floor portion of the bottom part being V-shaped in the longitudinal direction to accumulate the printing fluid received in the reservoir during the spitting process.

* * * * *